US005465887A

United States Patent [19]

Hudson

[11] Patent Number: 5,465,887

[45] Date of Patent: Nov. 14, 1995

[54] ARCHERY BOW BACKPACK CARRIER

[76] Inventor: Keith Hudson, 9920 Tulwar Dr., Chugiak, Ak. 99567

[21] Appl. No.: 112,129

[22] Filed: Aug. 26, 1993

[51] Int. Cl.[6] ..... A45F 3/04

[52] U.S. Cl. ..... 224/209; 224/916

[58] Field of Search ..... 224/209, 916, 224/210, 211, 261, 262

[56] References Cited

U.S. PATENT DOCUMENTS

| | | | |
|---|---|---|---|
| 2,280,003 | 4/1942 | Pearson | 224/916 |
| 2,823,971 | 2/1958 | Hoyt | 224/209 X |
| 3,648,907 | 3/1972 | Romney | 224/211 |
| 3,733,017 | 5/1973 | Pletz | 224/211 |
| 3,766,954 | 10/1973 | Gentellalli | 224/916 |
| 3,973,776 | 8/1976 | Ogle | 224/211 |
| 4,073,328 | 2/1978 | Franklin | 224/916 |
| 4,883,207 | 11/1989 | McArthur | 224/261 X |

OTHER PUBLICATIONS

*Gerry* Mountain Climbing & Camping Equipment Catalog—1964–65 Edition, p. 30.

*Primary Examiner*—Renee S. Luebke

*Attorney, Agent, or Firm*—Michael J. Tavella

[57] ABSTRACT

A new bow-carrying backpack is disclosed. Two different designs are disclosed. The first is designed to carry take-down bows, such as the modern recurve bow and the long bow. The second is used to carry compound bows. The invention consists of a backpack that has two specially designed side pockets. The first carries the parts of the disassembled bow. The second holds a supply of arrows in a protected shell. The pack includes storage space for accessories such as gloves, and incidentals and camping gear. In the compound bow carrier design, the bow is fastened to the back of the pack. The lower pulley fits into a special pulley pocket and VELCRO, a hook and loop fastening system, straps are provided to hold the bow onto the back of the pack. This permits the bow to be carried without difficulty through most types of terrain.

18 Claims, 3 Drawing Sheets

ARCHERY BOW BACKPACK CARRIER

This invention relates to carriers for archery bows and more particularly to such carriers when combined into a backpack carrier.

BACKGROUND OF THE INVENTION

Archery bows have existed for thousands of years. To date, many types of slings and carry bags have been designed to carry bows. Examples of sling designs can be found in U.S. Pat. Nos. 3,998,367, 4,754,904, 4,760,944, and 4,911,347. In addition to slings, bow bags have also been developed. Examples of these bags can be found in U.S. Pat. Nos. 3,058,505 and 4,480,774. U.S. Pat. No. 3,058,505 uses a bag shaped to hold a longbow as it is assembled. An assembled bow is often clumsy to carry. It tends to protrude and hit surrounding objects or can become stuck. This is especially true when hunting in a wooded area.

Today, bows come in three main styles. The first is the traditional longbow. The modern longbow may be one piece or may be joined at the center of the bow. The latter type of longbow can be carried in two separate pieces. The second major style of bow is the recurve bow. This bow comes in two or three pieces. In the three piece design, two detachable limbs are attached to a center riser. The limbs are typically fastened to the riser by thumb screws or similar fasteners. The types of bows that come in multiple pieces are typically called "take-down" bows. The third major style of bow is the compound bow. This bow uses mechanical advantage to decrease the pull. This type of bow does not disassemble for carrying or storage.

The present invention has three embodiments. The first is designed to carry take-down bows. The second is used to carry compound bows. The third is designed to carry one piece traditional longbows that are unstrung. All of the embodiments have arrow carrying capability, as will be discussed below.

The first embodiment of the invention consists of a backpack that has two specially designed side pockets. The first pocket carries the parts of the disassembled bow. The second holds a supply of arrows in a protected shell. The pack includes storage space for accessories such as gloves, cookware, food and other incidentals.

In the case of the compound bow carrier, the bow is fastened to the back of the pack. This permits the bow to be carried without difficulty through most types of terrain.

Finally, the traditional one-piece longbow, unstrung, can be stored in a protective sleeve that is attached to the pack by straps.

It is an object of this invention to create a bow carrying backpack for take-down style bows that carries the bow, arrows and related equipment in a compact, convenient, protected manner.

It is an object of this invention to create a bow carrying backpack for compound style bows that carries the bow, arrows and related equipment in a convenient, protected manner.

It is yet a further object of this invention to create a bow carrying backpack for traditional longbows and recurves that carries the bow, arrows and related equipment in a convenient protected manner.

DETAILED DESCRIPTION OF THE INVENTION

Figure 1:
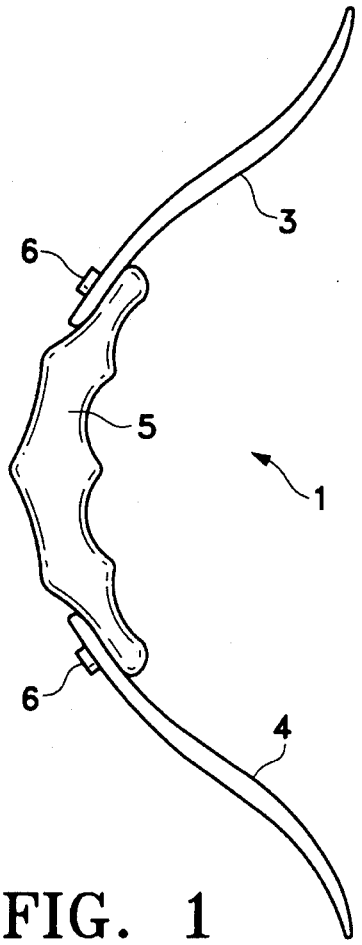
FIG. 1 (PRIOR ART)
FIG. 1 is a side view of an unstrung recurve bow.
Figure 2:
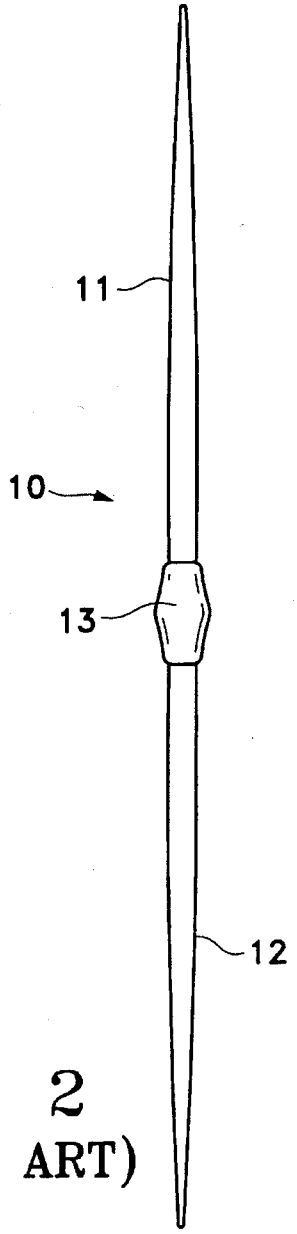
FIG. 2 (PRIOR ART)
FIG. 2 is a side view of an unstrung long bow.
Figure 3:
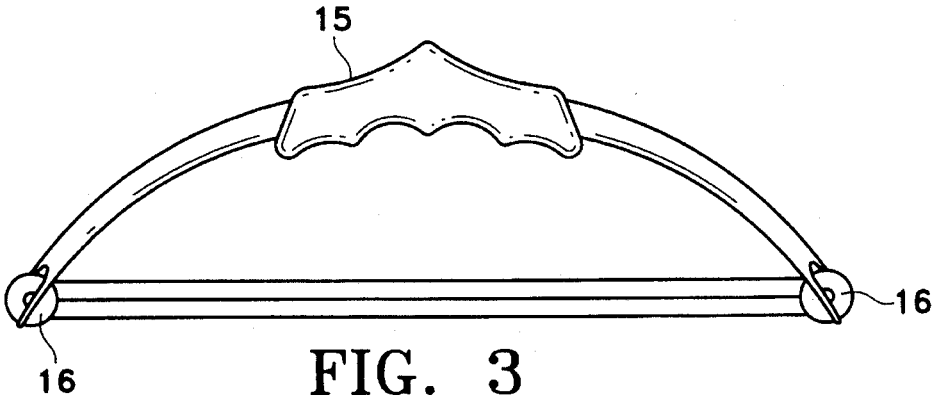
FIG. 3 (PRIOR ART)
FIG. 3 is a side view of a compound bow.
Figure 4:
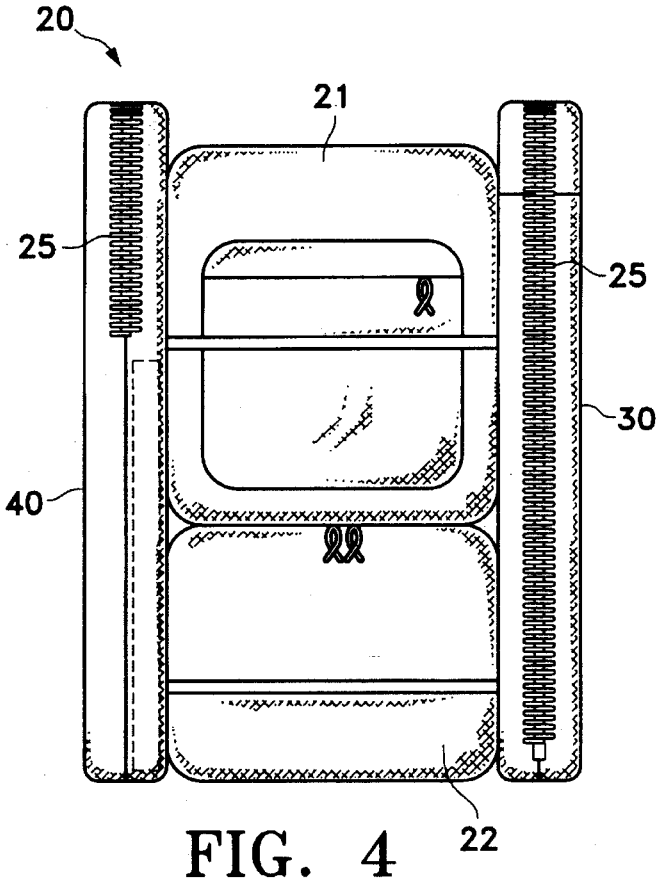
FIG. 4 is a rear view of the first embodiment of the present invention.

Referring now to FIG. 1, a typical recurve take-down bow 1 consists of two limbs 3 and 4 that connect to a riser 5. The limbs 3 and 4 attach to the riser 5 by thumb screws 6 or other fasteners typical to that art. The thumb screws permit the limbs to be attached to the riser and then to be easily disassembled for storage. FIG. 2 shows a typical unstrung long bow 10 it has two limbs 11 and 12 that are joined at joint 13. This joint permits the limbs to be separated, thus reducing the length of the bow for storage or transport. FIG. 3 shows a typical compound bow 15. This bow is strung with pulleys 16 to decrease the pull. Compound bows are not typically a take-down style of bow.

Figure 6:
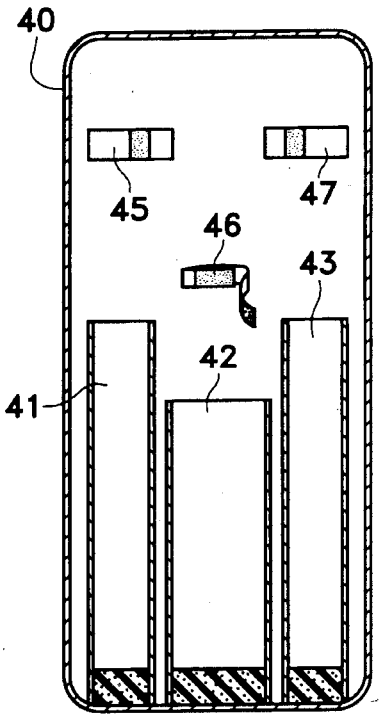
FIG. 6 is a cutaway side view of the bow pocket.

In the field, carrying these bows can be difficult. For example, a takedown style can be broken down into its component parts, to reduce the size of the bow, and then placed in a bag. In that case, however, the pieces can be damaged by being tossed about in the bag. Referring now to FIGS. 4–7, a unique pack design permits easy carrying of bows in the field. The pack 20 has two main sack compartments 21 and 22. These compartments act as normal back pack storage for cookware, sleeping bags and other gear. Two special side pockets are provided. The first 30 is designed to hold a supply of arrows (see FIG. 5). FIG. 6 shows the second pocket 40 that is used to store the bow parts. Both side pockets are held shut by zippers 25. In the preferred embodiment, the zippers run almost the entire length of the pocket on each side as well as the top. This permits the pocket to be opened almost completely to permit the bow and arrows to be stored easily. Zippers can be run in any other convenient manner as well.

Figure 5:
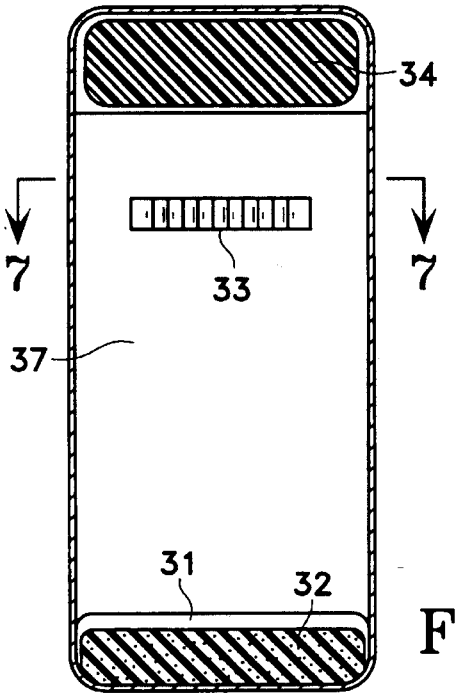
FIG. 5 is a cutaway side view of the arrow pocket.
Figure 7:
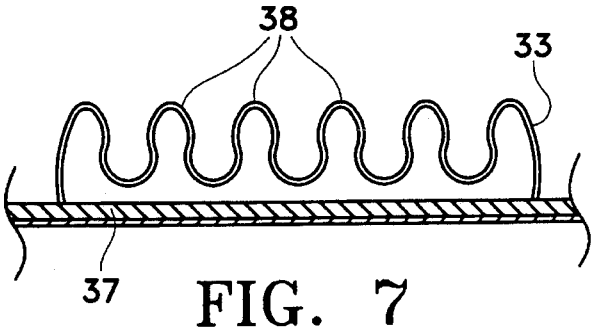
FIG. 7 is a plan view of the arrow holder taken along the lines 7—7.
Figure 9:
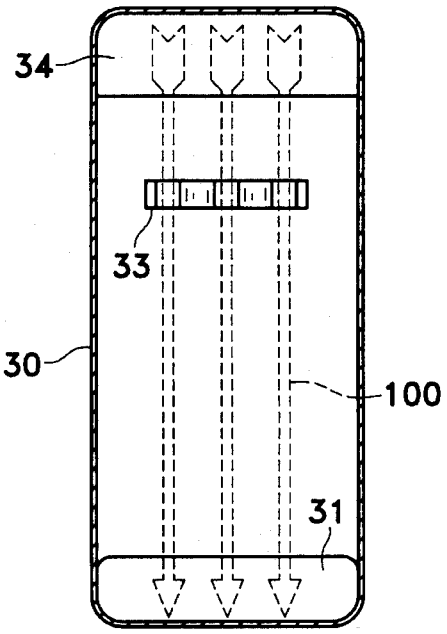
FIG. 9 is a cutaway view of the quiver pocket with arrows in place.

Referring now to FIG. 5, the arrow pocket has an arrow sheath 31 located at the bottom of the pocket. The sheath 31 is used to protect the arrow heads. A foam pad 32, placed within the sheath 31 is used to protect the arrow heads. An arrow holder 33 is provided near the top of the pocket to secure the arrow shafts. FIG. 7 shows the shape of the holder 33. It is designed to secure the arrow shafts between formed, friction fit, grips 38. In the preferred embodiment, 12 arrows can be carried in a staggered formation. FIG. 7 shows a straight formation arrow holder for illustration purposes. The arrow holder 33 is placed on a form 37. This form is generally rectangular and is designed to maintain the shape of the arrow pocket as well as holding the arrow holder 33. A hard plastic fletch shield 34 is placed at the top of the pocket to protect the fletching from damage. FIG. 9 shows arrows 100 being held in place in the pocket.

Figure 8:
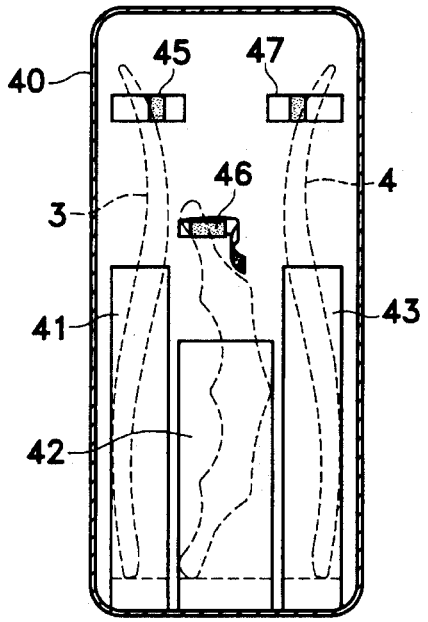
FIG. 8 is a cutaway side view of the bow pocket holding a disassembled recurve bow.

Referring now to FIG. 6, in the preferred embodiment of the first embodiment, the bow pocket 40 has three sleeves 41, 42, and 43. Sleeves 41 and 43 are used to hold the limbs. Sleeve 42 is used to hold the riser. Three VELCRO, a hook and loop fastener system, straps 45, 46 and 47 are placed above the sleeves to secure the free ends of the bow parts. FIG. 8 shows the pocket loaded with a typical recurve bow.

Figure 10:
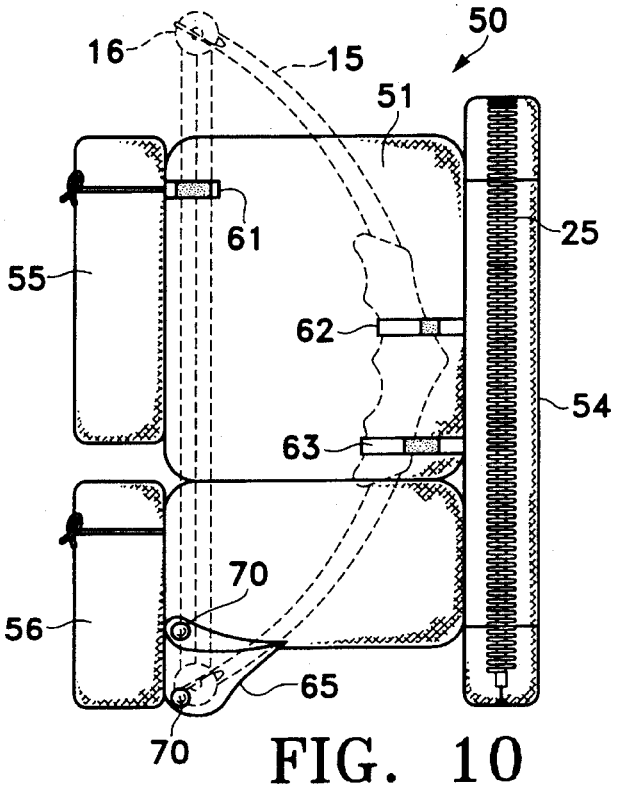
FIG. 10 is a rear view of a second embodiment of the invention with a compound bow in place.

Referring now to FIG. 10, a second embodiment of the invention is disclosed. This embodiment is used to hold compound bows because they are ordinarily not taken apart for carrying. Here, the pack 50 is divided into two compartments as before 51 and 52 as shown. The arrow pocket 54 is provided as before. The bow pocket has been replaced, however, with two smaller storage pockets 55 and 56, although a single large pocket may be substituted. These pockets can hold extra equipment as needed. The bow 15 is placed across the back of the pack. Three VELCRO, a hook and loop fastening system, strips 61, 62 and 63 secure the bow 15 to the pack 50. Of course, other common straps may be substituted for the VELCRO, a hook and loop fastening system. However, VELCRO, a hook and loop fastening system, is the preferred strap material. A pulley pocket 65 is placed at the bottom of the pack as shown. The lower pulley 16 of the bow 15 is placed inside this pocket to provide vertical support for the bow. A snap 70 or similar fastener, is provided to secure the pocket to the pack when the pocket is not in use.

Figure 11:
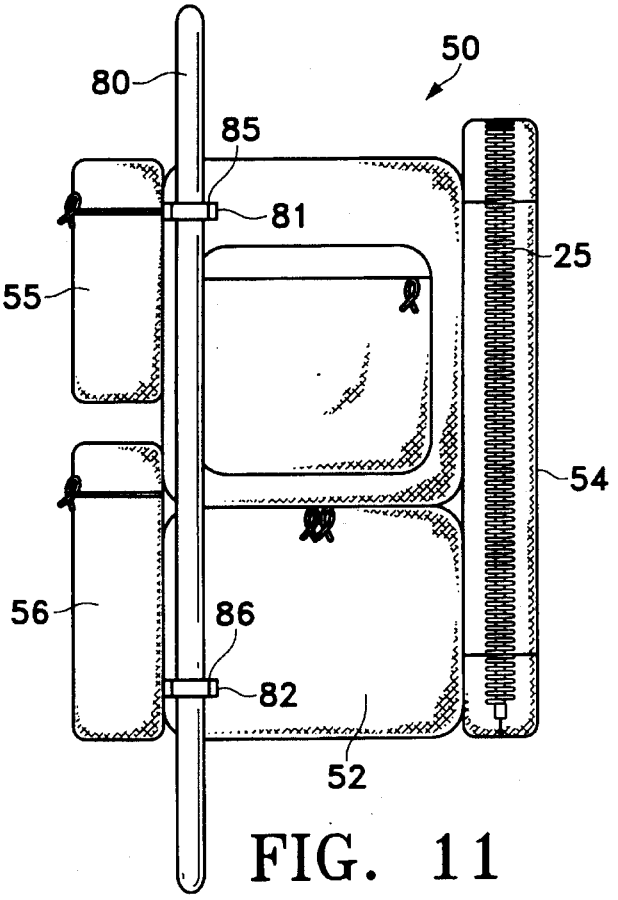
FIG. 11 is a rear view of a third embodiment of the invention with a compound bow in place.

Finally, referring to FIG. 11, the third embodiment of the invention is shown. Here, a sleeve 80 is used to encase an unstrung longbow. The sleeve 80 covers the entire bow. The sleeve is secured to the backpack 50 in a similar manner to that of the cross bow. Two VELCRO, a hook an loop fastening system, straps 81 and 82 are provided to hold the sleeve 80. Two loops 85 and 86 are fastened to the sleeve 80 to ensure the sleeve 80 remains attached to the bag 50.

All three embodiments use a pack made from pack cloth, polar fleece or cordura nylon, and metal frame parts common to the industry.

To use the first embodiment of the invention, a bow is first disassembled. In the case of the typical take-down recurve, three separate parts are produced. The limbs are placed in the limb sleeves and the riser is placed in the riser sleeves. In the case of a long bow, two parts are produced. In this case only the limb sleeves are needed. The carrying of the compound bow requires use of the second embodiment. Here, the bow is placed flat against the back of the pack. The lower pulley is placed within the pulley pocket VELCRO, a hook and loop fastening system, straps are then placed over the bow to secure it in place. Finally, in the case of the third embodiment, the sleeve is placed over the longbow and then the sleeve is secured to the back of the pack.

In all three embodiments, arrows are carried in the arrow pocket. The arrows are placed within the pocket head down. The fletching or vanes are placed in the fletch protector and the heads are then placed in the sheath in the bottom of the pocket. Finally, the shafts are secured in the pocket using the arrow holder.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A backpack for carrying archery bows capable of being disassembled into individual parts, each having an upper portion, a lower portion, and a central portion comprising:

a) a frame;

b) a main sack compartment being generally rectangular in shape and having a bottom and two sides, and being attached to said frame;

c) a bow pocket, fixedly attached to one side of said main sack, said bow pocket having means fixedly installed therein to hold the disassembled bow portions;

d) means to close said bow pocket;

e) an arrow pocket having an interior;

f) means to access the interior of said arrow pocket;

g) a frame fixedly placed within said arrow pocket, having means for holding an arrow shaft;

h) means for protecting an arrow head fixedly placed within said arrow pocket;

i) means for protecting arrow fletching, fixedly placed within said arrow pocket; and j) means for carrying said backpack, fixedly attached to the frame to permit said backpack to be carried.

2. The backpack for carrying archery bows of claim 1 wherein said main compartment is divided into 2 sections.

3. The backpack for carrying archery bows of claim 1 wherein said means installed within said bow pocket, to hold the disassembled bow portions comprises:

a) three sleeves for holding the disassembled bow portions, fixedly installed within said bow pocket such that each sleeve means holds one portion of the disassembled bow; and b) means for securing the disassembled bow portions, fixedly placed within said bow pocket, to secure the disassembled bow portions in place within said bow pocket.

4. The arrow pocket of claim 1 wherein said means for holding an arrow shaft comprise a formed strip having a plurality of friction fit grips to hold a quantity of arrows.

5. The arrow pocket of claim 1 wherein said means for protecting an arrow head comprise a hard plastic shell filled with a foam rubber pad.

6. The arrow pocket of claim 1 wherein said means for protecting arrow fletching comprise a hard plastic shell.

7. A backpack for carrying compound style archery bows comprising:

a) a frame;

b) a main sack compartment being generally rectangular in shape and having a bottom and two sides, and being attached to said frame;

c) at least one storage pocket, fixedly attached to one side of said main sack;

d) means to removably attach a compound bow to the main sack of said backpack;

e) means for carrying said backpack, fixedly attached to the frame to permit said backpack to be carried;

f) an arrow pocket having an interior;

g) means to access the interior of said arrow pocket;

h) a frame fixedly placed within said arrow pocket, having means for holding an arrow shaft;

i) means for protecting an arrow head fixedly placed within said arrow pocket; and j) means for protecting arrow fletching fixedly placed within said arrow pocket.

8. The arrow pocket of claim 7 wherein said means for holding an arrow shaft comprise a formed strip having a plurality of friction fit grips to hold a quantity of arrows.

9. The arrow pocket of claim 7 wherein said means for protecting an arrow head comprise a hard plastic shell filled with a foam rubber pad.

10. The arrow pocket of claim 7 wherein said means for protecting arrow fletching comprise a hard plastic shell.

11. The backpack for carrying archery bows of claim 7 wherein said main compartment is divided into 2 sections.

12. The backpack for carrying archery bows of claim 7 further comprising a second storage pocket fixedly attached to the backpack.

13. A backpack for carrying an assembled non-compound archery bow comprising:

a) a frame;

b) a main sack compartment being generally rectangular in shape and having a bottom and two sides, and being attached to said frame;

c) at least one storage pocket, fixedly attached to one side of said main sack;

d) a sleeve, said sleeve being removably placed over said assembled non-compound archery bow;

e) means to removably attach said sleeve to the main sack of said backpack;

f) an arrow pocket having an interior;

g) means to access the interior of said arrow pocket;

h) a frame fixedly placed within said arrow pocket, having means for holding an arrow shaft;

i) means for protecting an arrow head fixedly placed within said arrow pocket;

j) means for protecting arrow fletching, fixedly placed within said arrow pocket; and j) means for carrying said backpack, fixedly attached to the frame to permit said backpack to be carried.

14. The arrow pocket of claim 13 wherein said means for holding an arrow shaft comprise a formed strip having a plurality of friction fit grips to hold a quantity of arrows.

15. The arrow pocket of claim 13 wherein said means for protecting an arrow head comprise a hard plastic shell filled with a foam rubber pad.

16. The arrow pocket of claim 13 wherein said means for protecting arrow fletching comprise a hard plastic shell.

17. The backpack for carrying an assembled non-compound archery bow of claim 13 wherein the means to removably attach said sleeve to the main sack of said backpack comprise a plurality of straps fixedly attached to said pack.

18. The backpack for carrying an assembled non-compound archery bow of claim 17 wherein said sleeve further comprises loop portions, fixedly attached to said sleeve to permit said straps to pass through said loops and secure said sleeve to said pack.

* * * * *